United States Patent [19]
Ushijima
[11] 4,229,878
[45] Oct. 28, 1980

[54] METHOD OF OPERATING A REHEATING FURNACE IN A HOT ROLLING LINE AND A REHEATING FURNACE EMPLOYED THEREFOR

[75] Inventor: Shigemi Ushijima, Nagaokakyo, Japan

[73] Assignee: Chugairo Kogyo Kaisha Ltd., Osaka, Japan

[21] Appl. No.: 965,707

[22] Filed: Nov. 30, 1978

[51] Int. Cl.[3] ..... B22D 11/126

[52] U.S. Cl. ..... 29/527.7; 432/52; 432/239; 414/159

[58] Field of Search ..... 29/527.7; 198/576, 577, 198/579; 414/159; 432/239, 246, 52; 72/202

[56] References Cited

U.S. PATENT DOCUMENTS

| | | | |
|---|---|---|---|
| 2,224,895 | 12/1940 | Brooke | 414/159 |
| 3,254,778 | 6/1966 | Marland et al. | 198/579 |
| 3,648,359 | 3/1972 | Dennis | 29/527.7 |
| 3,706,370 | 12/1972 | Bonafino et al. | 198/577 |

*Primary Examiner*—Lowell A. Larson
*Attorney, Agent, or Firm*—Wenderoth, Lind & Ponack

[57] ABSTRACT

A heating method of operating a furnace in a hot rolling line and a heating furnace therefor in which the reheating furnace is positioned between a continuous casting apparatus and a rolling apparatus rolling workpieces at a higher speed than they are cast by the casting process, the furnace serving as a heating and buffer zone. The reheating furnace includes at least three moving beams each having an independent driving mechanism, and coupling mechanisms which couple the neighboring moving beams for independent or synchronous movement, while the moving beams are so arranged that, by operating the driving mechanism, they are altered in their speeds to the discharging speed of the workpieces from the continuous casting process, or one or two of the moving beams are brought into idling state or driven at the rolling speed.

5 Claims, 5 Drawing Figures

METHOD OF OPERATING A REHEATING FURNACE IN A HOT ROLLING LINE AND A REHEATING FURNACE EMPLOYED THEREFOR

BACKGROUND OF THE INVENTION

The present invention relates to a hot rolling process, and more particularly to a method of operating a reheating furnace in a hot rolling line.

Commonly, in modern steel making plants, achievement of energy and labor savings and high efficiency has constantly been sought by making various processes involved continuous. The production line ranging from a continuous casting process to the rolling process has been included in such efforts, and making such process continuous has been attempted by arranging a reheating furnace between the continuous casting machine and the rolling mill. In the conventional arrangements as described above, since the speed for the continuous casting differs to a large extent from that of the rolling, with the latter being normally several times higher than the former, the reheating furnace employed is required to serve as a buffer or absorbing zone for absorbing the difference in through put capacity between the two processes as far as possible. More specifically, in order to meet the requirement as described above, it becomes necessary to employ a reheating furnace capable of simultaneously discharging workpieces for rolling at a higher speed and continuously being charged with workpieces from the casting process at a lower speed without altering the transportation rate of such workpieces. Additionally, such a reheating furnace should be so arranged as to achieve high operating efficiency of the rolling apparatus and labor saving through reduction, as far as possible, of the frequency of on-off operations for the rolling mill operated at high speed by storing therein a predetermined amount of workpieces to be rolled which have been cast continuously at low speed and also by collectively forwarding such workpieces in one group from the furnace to the rolling mill. For the purpose as described above, the reheating furnace must be provided, without increasing the length thereof, with heating and heat holding capability for retaining the heat of heated workpieces to be rolled until the workpiece last charged into the furnace has been heated up to the predetermined rolling temperature.

SUMMARY OF THE INVENTION

Accordingly, an essential object of the present invention is to provide an improved heating method for workpieces or materials to be rolled in a hot rolling line in which the idling time of a reheating furnace is advantageously shortened for efficient heating and holding of workpieces to be rolled, with simultaneous reduction of furnace length for substantial elimination of the disadvantages inherent in the conventional heating methods.

Another important object of the present invention is to provide an improved reheating furnace for effecting the heating method as described above in an effecient manner at low installation cost.

A further object of the present invention is to provide a reheating furnace of the above described type which is simple in construction and stable in operation and can readily be incorporated into the hot rolling line.

In accomplishing these and other objects, according to one preferred embodiment of the present invention, a reheating furnace is arranged between the continuous casting apparatus casting billets or slabs at a low speed and a rolling apparatus rolling slabs at a higher speed than the slab is being cast, the reheating furnace serving as a heating and buffer zone. The reheating furnace includes at least three moving beams each having an independent driving mechanism, and coupling mechanisms which couple the neighboring moving beams for independent or synchronous movement, while the moving beams are so arranged that, by operating the driving mechanism, they are altered in their speeds to the discharging speed of the workpieces from the continuous casting process, or one or two of the moving beams are brought into idling state or moved at the rolling speed. By the above arrangement, not only is the idling time of the furnace advantageously reduced, but the length of the furnace is shortened, with substantial elimination of disadvantages inherent in the conventional reheating furnaces of such type.

BRIEF DESCRIPTION OF THE DRAWINGS

These and other objects and features of the present invention will become apparent from the following description of a preferred embodiment thereof with reference to the accompanying drawings, in which.

Before the description of the present invention proceeds, it is to be noted that like parts are designated by like reference numerals throughout the several views of the accompanying drawings.

DETAILED DESCRIPTION OF THE INVENTION

Figure 1:
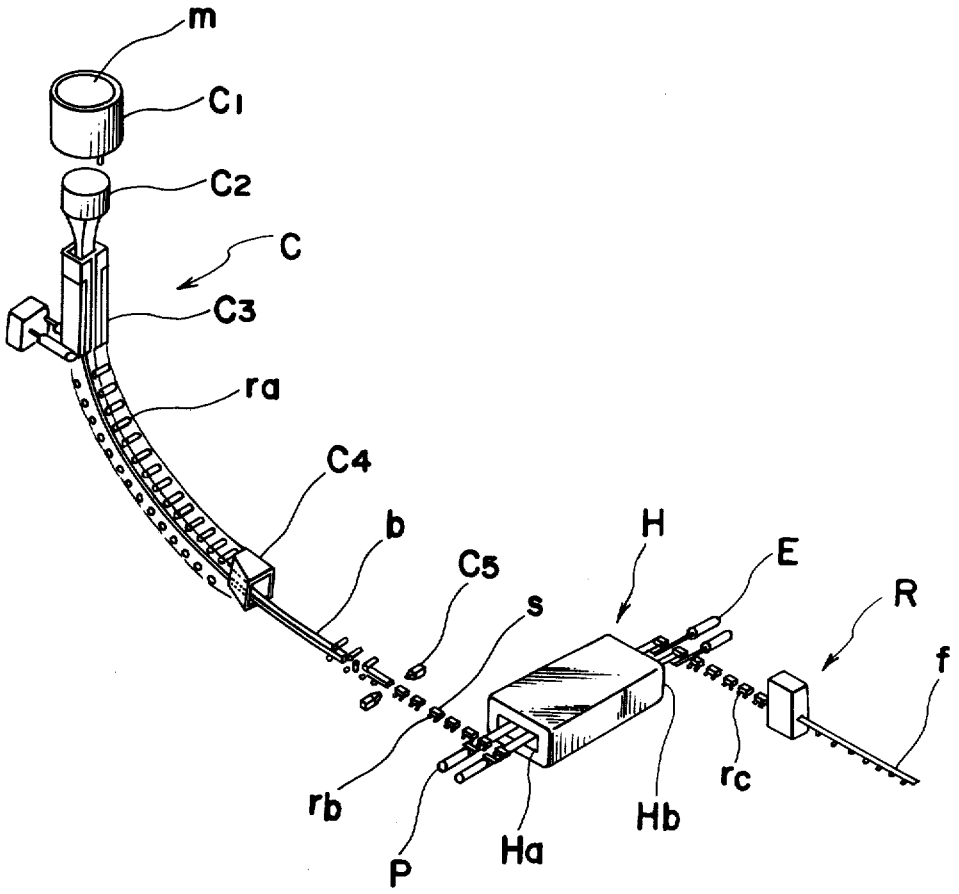
FIG. 1 is a perspective view showing an arrangement of a hot rolling line from a continuous casting apparatus to a rolling apparatus and to which the present invention may be applied.

Referring now to the drawings, there is shown in FIG. 1 an arrangement of a hot rolling line ranging from the continuous casting apparatus C to the rolling apparatus R between which a reheating furnace H directly related to the present invention and described later in more detail with reference to FIGS. 2 to 5 is arranged as a heating and buffer zone. In the continuous casting apparatus C, molten metal m contained in a ladle $C_1$ is fed into a tundish $C_2$ to be subsequently molded in a mold assembly $C_3$ into a continuous cast material, for example, in the form of a bar b, which is led between a number of pairs of guide rolls $r_a$ along a curved path through a straightener $C_4$ and the like sequentially arranged, and is subsequently cut into workpieces i.e., billets or slabs and the like by cutting means $C_5$ in a known manner. The billets s thus formed are further transported by transportation rolls $r_b$ to a charge table (not shown) arranged adjacent to the charge side Ha of the reheating furnace H and are charged into the furnace H by pusher means P. The billets s processed in the furnace H in a manner described later are then discharged from the furnace H onto a discharge table (not shown) arranged on the discharge side Hb of the furnace H by the action of the extractor means E, and are further fed into the rolling apparatus R by transportation rolls $r_c$ so as to be rolled, for example, into the form of steel plates f.

Figure 2:
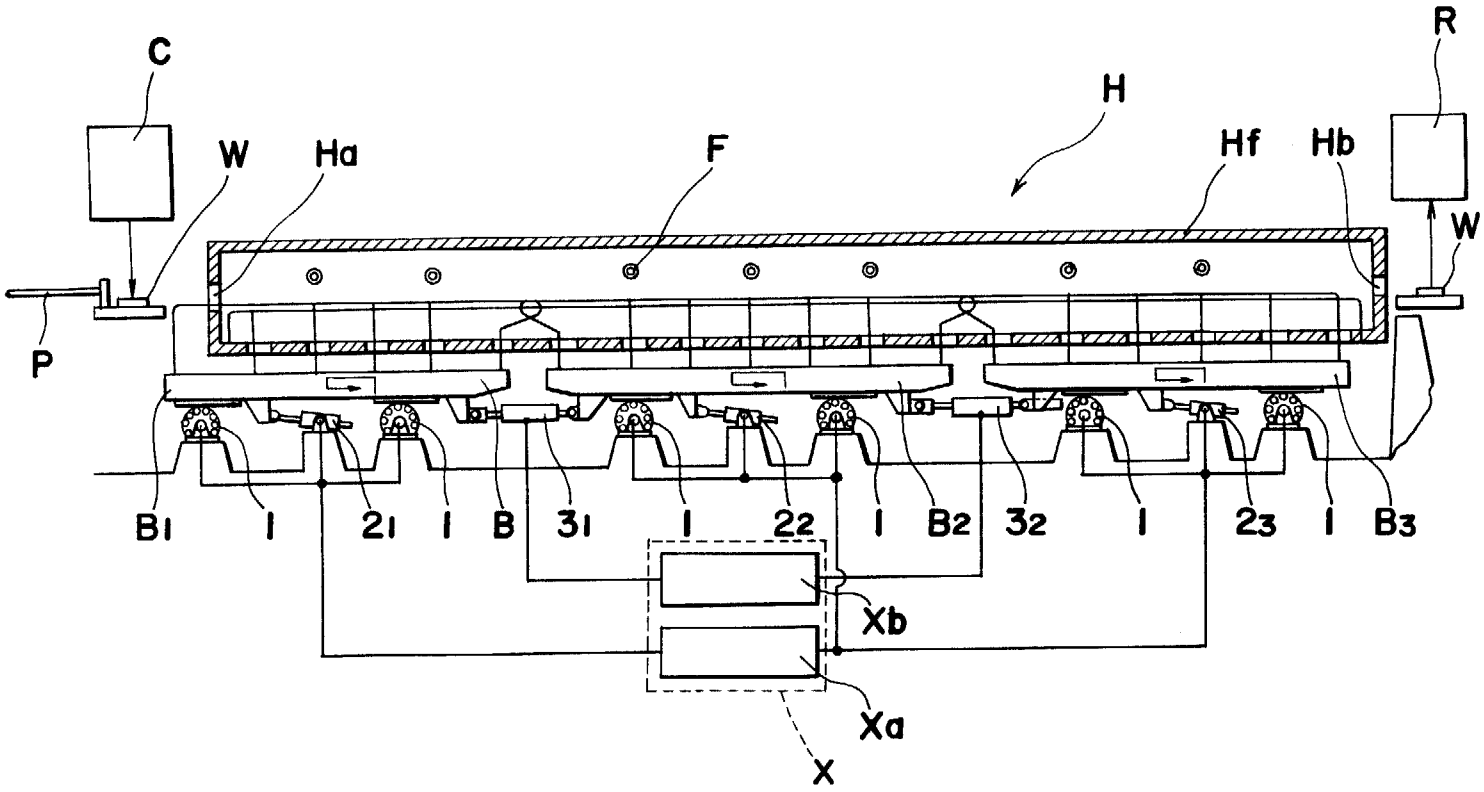
FIG. 2 is a schematic side sectional view of a reheating furnace according to one preferred embodiment of the present invention.

Referring also to FIG. 2, the reheating furnace H according to the present invention, for example, of the walking beam type, includes a housing or furnace body Hf of refractory material supported above the ground by suitable support members (not shown), and longitudinally extending from the charge end Ha to the discharge end Hb of the furnace H for the workpieces W (i.e., the billets s), moving or walking beam means B movably accommodated in the furnace body Hf and longitudinally divided, for example, into three sections or moving beams $B_1$, $B_2$ and $B_3$, and a plurality of burner means F, for example, axial-flow burners, provided in the furnace body Hf at predetermined intervals for heating the workpieces W. The moving beams $B_1$, $B_2$ and $B_3$ are associated with each other through eccentric wheels 1 rotatably disposed below the beams $B_1$ to $B_3$ and coupled to a driving source (not shown) such as a motor or the like for vertical movement of the respective beams $B_1$ to $B_3$, hydraulic cylinder $2_1$, $2_2$ and $2_3$ also disposed below the beams $B_1$ to $B_3$ for horizontal driving of the beams, and coupling mechanisms $3_1$ and $3_2$ such as a magnetic clutches or the like provided between the neighboring beams $B_1$ and $B_2$, and $B_2$ and $B_3$ for independently driving each of the beams $B_1$ to $B_3$ or for synchronized driving of the beams $B_1$ to $B_3$. For proper driving of the moving beams $B_1$ to $B_3$, the eccentric wheels 1 and hydraulic cylinders $2_1$, $2_2$ and $2_3$ are coupled to a speed control circuit Xa of a control means X including a conventional logical operation circuit in a known manner, while the coupling mechanisms $3_1$ and $3_2$ are connected to a coupling control circuit Xb of the control means X.

Figure 3:
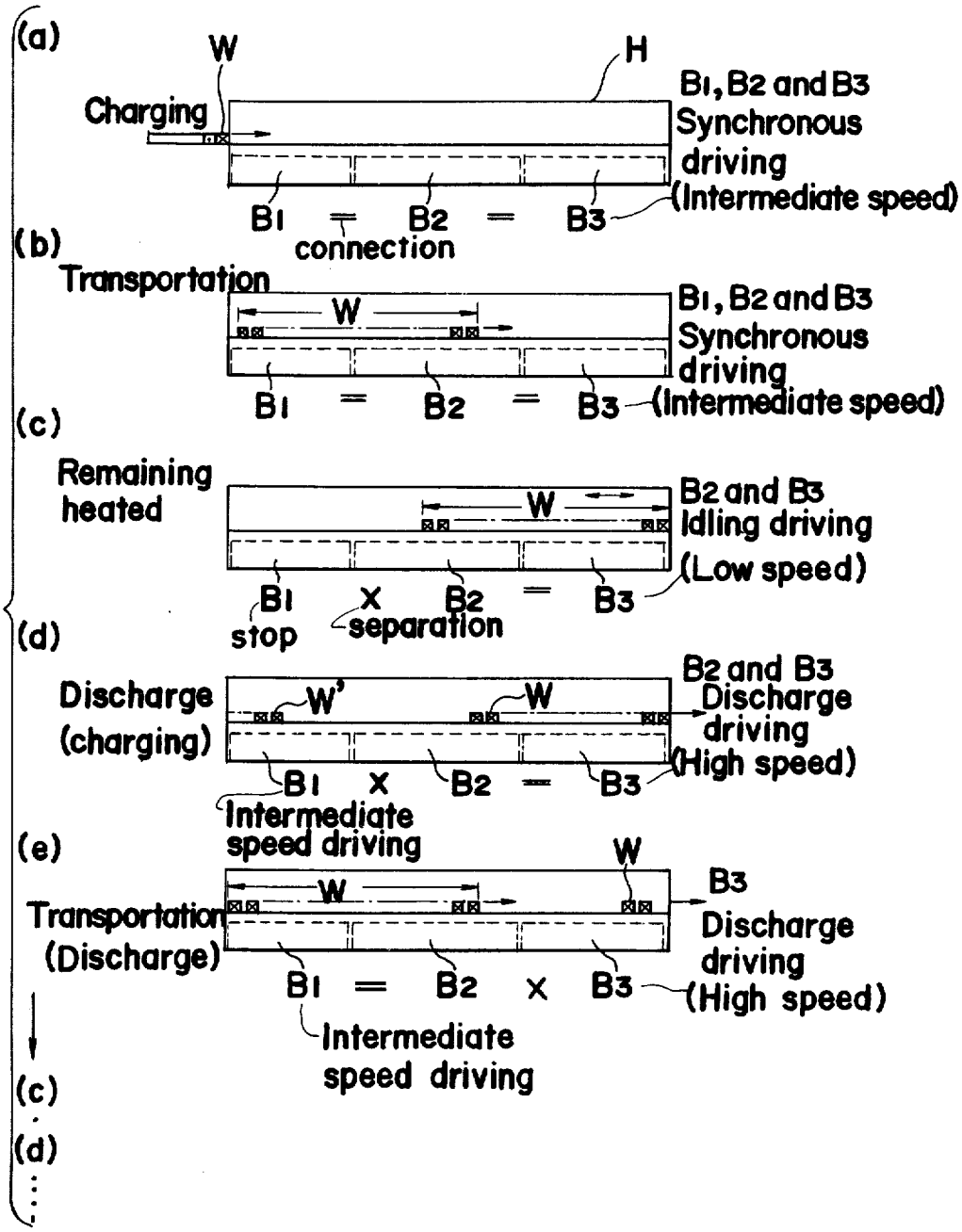
FIG. 3 is a diagram explanatory of the sequence of operations of the reheating furnace of FIG. 2.

Referring also to FIG. 3, operations of the reheating furnace H of FIG. 2 will be described hereinbelow.

On the assumption that the workpieces, for example, billets W to be rolled produced by the continuous casting process C are continuously charged into the reheating furnace H at an intermediate transportation speed of 0.3 m/min, starting from the state (a) of FIG. 3, the moving beams $B_1$, $B_2$ and $B_3$ are subjected to associated driving by the coupling mechanisms $3_1$ and $3_2$ for simultaneous movements at a speed of 0.3 m/min, and the workpieces W to be rolled are sequentially transported to the discharge end Hb, while being heated by the burners F shown in FIG. 2 (FIG. 3(*b*).

When all of the workpieces W have been charged into the furnace H, with a leading one of the workpieces W in the group of the workpieces reaching the discharge end Hb (FIG. 3(*c*), the moving beam $B_1$ is cut off or separated from the moving beam $B_2$ through actuation of the coupling mechanism $3_1$ by the control circuit Xb, while the beams $B_2$ and $B_3$ are associated with each other by the coupling mechanism $3_2$ so as to move merely up and down at a low idling speed for effecting an idling process, i.e., heat-reserving process. Subsequently, after the elapse of a predetermined time, the workpieces W are discharged by the synchronized driving of the moving beams $B_2$ and $B_3$ at a high discharge speed of 0.58 m/min to be transported toward the rolling apparatus R. It is to be noted here that the discharging or transportation speeds for the beams $B_2$ and $B_3$ are to be altered by variation of the cycle time.

Meanwhile, workpieces or billets W' newly produced by the continuous casting apparatus C are sequentially charged onto the beam $B_1$ for being transported at the intermediate transportation speed of 0.3 m/min (FIG. 3(*d*)). More specifically, in the state of FIG. 3(*d*), the moving beam $B_1$ transports the workpieces W' at the intermediate transportation speed of 0.3 m/min, while the moving beams $B_2$ and $B_3$ subjected to the associated movements through the coupling mechanism $3_2$ feed the workpieces W at a high transportation speed of 0.58 m/min. Subsequently, when the workpieces W on the moving beam $B_2$ are transferred onto the beam $B_3$, the beams $B_1$ and $B_2$ are subjected to the associated movement through the coupling mechanism $3_1$ for sequentially transporting the workpieces W' at the intermediate transportation speed of 0.3 m/min, while the beam $B_3$ separated from the beam $B_2$ by the functioning of the coupling mechanism $3_2$ continuously discharges the workpieces W at the high discharging speed of 0.58 m/min (FIG. 3(*e*)). In other words, in the state of FIG. 3(*e*), the beams $B_1$ and $B_2$ are subjected to the associated movement by the coupling mechanism $3_1$ and transport the group of the workpieces W' at the intermediate transportation speed of 0.3 m/min, while the beam $B_3$ discharges the workpieces W at the high discharging speed of 0.58 m/min.

Upon completion of the discharging of the group of the workpieces W, the beam $B_3$ is again associated in its movement with the beam $B_2$ being subjected to the associated movement with the beam $B_1$ by the functioning of the coupling mechanism $3_2$, and is altered in its transportation speed to 0.3 m/min in synchronization with the beams $B_1$ and $B_2$ for sequentially feeding the group of the workpieces W' toward the discharge side Hb. Subsequently, the furnace H is brought back to the state of FIG. 3(*c*), and the workpieces W produced by the continuous casting apparatus C at a predetermined time interval are charged into the reheating furnace H irrespective of the rolling starting time.

Figure 4:
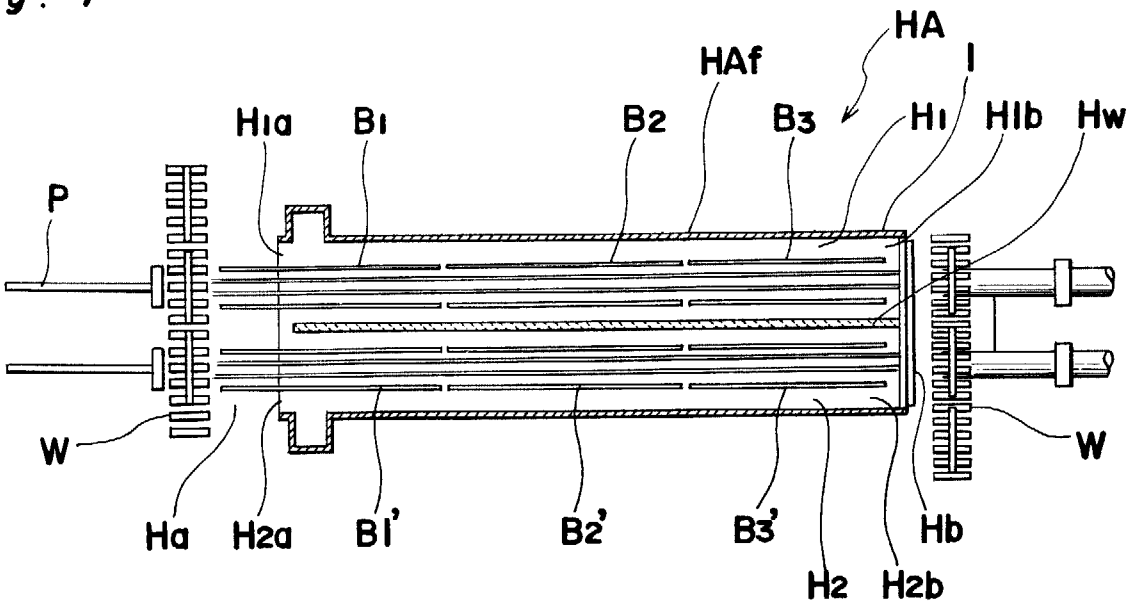
FIG. 4 is a schematic top plan view showing a structure of a reheating furnace according to a modification of the arrangement of FIG. 2.
Figure 5:
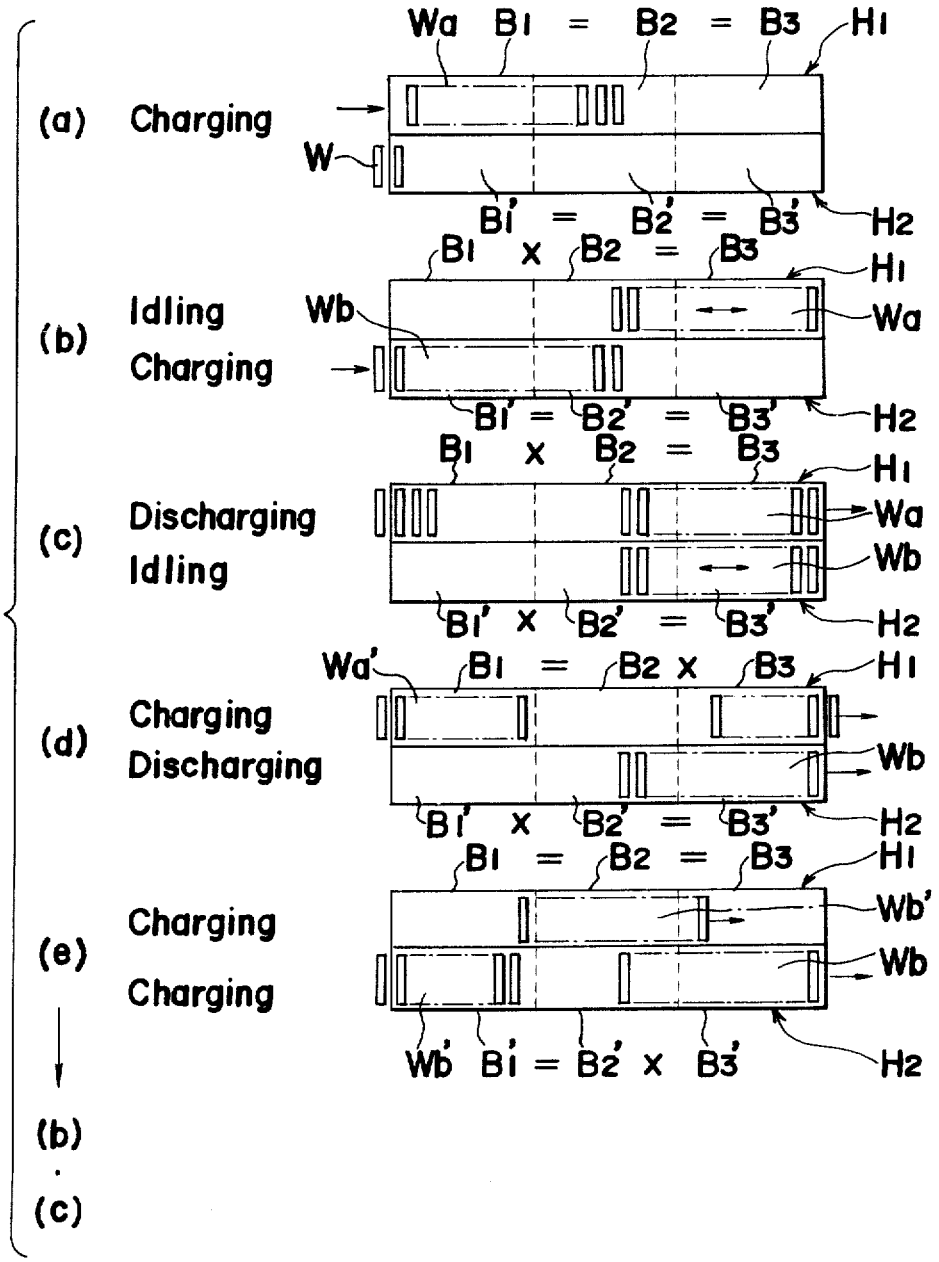
FIG. 5 is a similar view to FIG. 3, but particularly showing the sequence of operations of the modified reheating furnace of FIG. 4.

Referring now to FIGS. 4 and 5, there is shown in FIG. 4 a modification of the reheating furnace H of FIGS. 2 and 3. In the modified reheating furnace HA of FIG. 4, the furnace body HAf has a partition wall Hw built, for example, of refractory bricks at approximately the central portion thereof and longitudinally extending from the charge end Ha to the discharge end Hb of the furnace HA for dividing the interior of the furnace HA into two rows of independent heating sections $H_1$ and $H_2$ provided with separate inlets H1*a* and H2*a* and outlets H1*b* and H2*b* for the workpieces W respectively, while the heating sections $H_1$ and $H_2$ longitudinally divided at least into three portions include the moving beams $B_1$, $B_2$ and $B_3$, and $B_1'$, $B_2'$ respectively in a manner similar to that of the furnace H of FIG. 2.

Referring to FIG. 5, operations of the reheating furnace HA of FIG. 4 will be described hereinbelow.

When the workpieces to be rolled, for example billets W cast by the continuous casting process C, are charged in the heated state into the first heating zone $H_1$ at a charging speed (discharging speed) of 0.3 m/min, the beams $B_1$, $B_2$ and $B_3$ are driven at a transportation speed of 0.3 m/min for successively transporting the workpieces W which are being heated by the burners F shown in FIG. 2, and upon arrival of the workpieces W at an intermediate portion of the beam $B_2$ (the amount of the workpieces W is equivalent to half the amount thereof cast by one continuous casting operation), subsequent workpieces W are changed over to be charged into the second heating section $H_2$ and successively transported while being heated by the burners F shown in FIG. 2 (FIG. 5(*a*)). Subsequently, when the leading end of the group of the workpieces Wa in the first heating section $H_1$ has reached the discharge side H1b, the moving beams $B_2$ and $B_3$ are subjected to associated movement to start the idling process for keeping the group of the workpieces Wa heated (FIG. 5(*b*)). Thereafter, the group of the workpieces Wb in the second heating section $H_2$ is also kept heated, while the workpieces W from a second continuous casting process are charged into the first heating section $H_1$, and after transportation by the beam $B_1$ for the predetermined period of time, the beams $B_2$ and $B_3$ in the first heating section $H_1$ start the discharging process for discharging the workpieces Wa at the speed of 0.58 m/min (FIG. 5(*c*)). Subsequently, when the workpieces W on the second beam $B_2$ are transferred onto the beam $B_3$, the moving beams $B_1$ and $B_2$ are subjected to the associated movement at the transportation speed of 0.3 m/min for transporting the subsequent group of the workpieces Wa' also onto the beam $B_2$ (FIG. 5(*d*)). Upon completion of the discharging of the workpieces W on the beam $B_3$, beam $B_3$ is also subjected to the associated movement with the beams $B_1$ and $B_2$ for transporting movement at the speed of 0.3 m/min, and when the subsequent group of the workpieces Wa' (equivalent in amount to half the amount produced by the second continuous casting process) is charged, change-over is effected for charging into the second heating section $H_2$, and thus, in a manner similar to that in the first heating section $H_1$, the group of the workpieces Wb in the second heating section $H_2$ is discharged at the speed of 0.58 m/min (FIG. 5(*e*)), while the beams $B_2'$ and $B_3'$ are sequentially changed over to the transporting speed of 0.3 m/min for transporting the subsequent workpieces Wb' toward the discharge side H2*b*.

Thereafter, the furnace HA is brought into the state as shown in FIG. 5(*b*), and the workpieces continuously cast at the continuous casting process C remain heated in the first or second heating section $H_1$ or $H_2$ for being continuously rolled by the rolling apparatus R at a predetermined time interval.

It should be noted here that, although the present invention is mainly described with reference to the top and bottom firing type walking beam furnace in the foregoing embodiment, the invention is not limited in its application only to such a walking beam furnace, but may readily be applicable to a top firing type walking hearth furnace having a brick hearth.

It should also be noted that the present invention is not limited in its application to a continuous hot rolling line ranging from the continuous casting apparatus to the rolling apparatus, but can effectively be employed as a buffer furnace for a continuous processing line from a blooming mill to a rolling apparatus, for example, a slabing mill, in the hot direct rolling process (HDR) which has recently been proposed.

As is clear from the foregoing description, according to the present invention, the moving beam means of the reheating furnace is longitudinally divided into at least three portions or three moving beams, which can be driven by separate driving means respectively so that the high speed discharging and low speed continuous charging of the workpieces may be effected simultaneously through proper change-over of the driving mechanisms without altering the transportation rate of the workpieces to be rolled for effective utilization of the moving beams, and thus, it has been made possible to achieve energy saving, with reduced furnace length.

Although the present invention has been fully described by way of example with reference to the attached drawings, it is to be noted that various changes and modifications will be apparent to those skilled in the art. Therefore, unless otherwise such changes and modifications depart from the scope of the present invention, they should be construed as being included therein.

I claim:

1. A method for heating workpieces in a reheating furnace in a hot rolling line of the type including a casting system for continuously casting workpieces to be rolled, a heating system to receive said workpieces from said casting system and to heat said workpieces and a rolling system to receive heated workpieces from said heating system and to roll said workpieces at a rolling speed greater than the casting speed of said casting system, said heating method comprising:

(1) providing said heating system as a single reheating furnace having a longitudinal direction extending between a charging end adjacent said casting system and a discharging end adjacent said rolling system, and moving means for moving said workpieces through said furnace from said charging end thereof to said discharging end thereof, said moving means divided in said longitudinal direction into at least three walking beams each being independently movable in vertical and horizontal directions;

(2) successively charging a first plurality, equal to a rolling quantity of workpieces to be rolled by said rolling system in a single rolling cycle, of cast workpieces from said casting system into said charging end of said furnace at said casting speed;

(3) operating said walking beams to transport at a predetermined speed said first plurality of workpieces in said longitudinal direction through said furnace while therein heating said workpieces;

(4) upon the arrival of the leading of said first plurality of workpieces at said discharging end, operating said walking beams to interrupt said transport, and maintaining said first plurality of workpieces within said furnace while continuing said heating thereof;

(5) while said first plurality of workpieces are maintained and heated within said furnace, initiating the successive charging of a second plurality of cast workpieces from said casting system into said charging end of said furnace at said casting speed;

(6 ) during the charging of said second plurality of workpieces, and after said first plurality of workpieces have been heated for a predetermined period of time, operating said walking beams to discharge said first plurality of workpieces from said discharging end of said furnace to said rolling system at a discharge speed greater than said predetermined speed and in synchronization with said rolling speed;

(7) during said discharging, continuing to charge said second plurality of workpieces into said charging end of said furnace, until said second plurality equals said first plurality;

(8) operating said walking beams to transport at said predetermined speed said second plurality of workpieces in said longitudinal direction through said furnace while therein heating said workpieces;

(9) upon the arrival of the leading of said second plurality of workpieces at said discharging end, operating said walking beams to interrupt said transport, and maintaining said second plurality of workpieces within said furnace while continuing said heating thereof; and

(10) subsequently sequentially repeating said steps (5), (6), (7), (8) and (9) for successive further pluralities of cast workpieces.

2. A method as claimed in claim 1, further comprising providing said furnace with a partition wall extending in said longitudinal direction between said changing and discharging ends, thereby dividing said furnace into two laterally separated heating zones, each said heating zone having therein said at least three walking beams, and wherein said step of charging each said plurality of cast workpieces comprises charging a first approximately one-half said plurality of workpieces into one of said heating zones, and charging the second remaining one-half said plurality of workpieces into the other of said heating zones, said charging of said second one-half occurring at least partially during transport of said first one-half toward said discharge end, and wherein said step of discharging each said plurality of cast workpieces comprises initiating discharge of said second one-half subsequent to completion of the discharge of said first one-half.

3. A reheating furnace for heating workpieces in a hot rolling line of the type including a casting system for continuously casting workpieces to be rolled, and a rolling system for rolling said workpieces at a rolling speed greater than the casting speed of the casting system, with the reheating furnace directly coupling the casting and rolling systems, said reheating furnace comprising:

a furnace housing having therethrough a furnace chamber extending in a longitudinal direction between a charging end adjacent the casting system and a discharging end adjacent the rolling system;

moving means for transporting said workpieces through said furnace chamber in said longitudinal direction from said charging end to said discharging end, said moving means comprising:

at least three separate walking beams spaced in said longitudinal direction along said furnace chamber;

separate driving means, operatively connected to each said walking beam, for imparting vertical and horizontal movements to each said walking beam; and separate coupling means, operatively connected to each adjacent pair of said walking beams, for coupling said respective pair of walking beams for synchronized movement thereof and for uncoupling said respective pair of walking beams to enable independent movement thereof; and heating means within said furnace chamber for heating said workpieces during transport thereof through said furnace chamber.

4. A furnace as claimed in claim 3, further comprising a partition wall within said furnace chamber said partition wall extending in said longitudinal direction between said charging and discharging ends and dividing said furnace chamber into two laterally separated heating zones, and wherein said moving means comprises at least three said walking beams in each said heating zone.

5. A furnace as claimed in claim 3, wherein said driving means for each said walking beam includes means for altering the speed of movement of said workpieces in said longitudinal direction.

* * * * *